United States Patent [19]

Bonner

[11] 4,062,207

[45] Dec. 13, 1977

[54] LOCK MOUNTING FOR ZIPPERED SECURITY BAG

[75] Inventor: Cletus D. Bonner, Beaver, Pa.

[73] Assignee: Strayer Coin Bag Company, Inc., New Brighton, Pa.

[21] Appl. No.: 713,119

[22] Filed: Aug. 10, 1976

[51] Int. Cl.[2] ..... E05B 67/38

[52] U.S. Cl. ..... 70/68; 70/70

[58] Field of Search ..... 70/68, 69, 70, 71, 72, 70/73-76; 24/141

[56] References Cited

U.S. PATENT DOCUMENTS

| | | | |
|---|---|---|---|
| 914,705 | 3/1909 | Donnelly | 24/141 |
| 3,785,185 | 1/1974 | Kerr | 70/68 |

*Primary Examiner*—Robert L. Wolfe

*Attorney, Agent, or Firm*—W. Britton Moore

[57] ABSTRACT

A zippered opening flexible walled security container having a lock for securing the zipper slide fastener in locked position wherein the lock is so secured to the container walls to prevent button holing of the attachment means and back feeding of the lock and slide fastener to provide access to the container and surreptitious removal of its contents.

9 Claims, 9 Drawing Figures

PRIOR ART

PRIOR ART

LOCK MOUNTING FOR ZIPPERED SECURITY BAG

This invention relates to a zippered opening flexible walled security container having a lock for securing the zipper slide fastener in locked position wherein the rivet securing the lock to the container walls is provided with backing means which precludes button holding the rivet to enable back feeding of the lock and slide fastener to gain unauthorized access to the container without opening the lock.

It has been customary to employ flexible walled lock controlled zippered opening security containers in banking and particularly when handling bank deposits, with this type container being illustrated in representative U.S. Pats. to Strayer, No. 2,112,795 dated Mar. 29, 1938, Rifkin, No. 3,759,073 — Sept. 18, 1973, Kerr, No. 3,580,016 — May 25, 1971, and No. 3,785,185 — Jan. 15, 1974. However, bankers and customers have encountered problems with depository shortages because it has been possible to button hole the rivets attaching the lock to the container walls so as to disengage the lock therefrom whereupon the lock and slide fastener connected thereto may be back fed to provide as access opening for surreptitious removal of the contents, after which the lock and slide fastener may be repositioned and the rivets replaced without any noticeable damage to the container. This is fast becoming a serious problem and endangers the future of this industry.

The principal object of the present invention it to overcome the above discussed problems by securing the lock attaching rivets to the flexible container walls with metal backing eyelets and washers which preclude the insertion of a prying instrument under the eyelet and through the wall openings to disconnect the rivets and free the lock at the sides thereof from the container.

Another object is to provide a lock mounting for a zippered opening flexible walled container wherein the lock is secured at the bight and side portions of the lock housing by rivets which project through openings in the container walls and a covering collar at one end thereof with the rivet heads disposed exteriorly, and metal backing eyelets and/or washers are disposed to the rear of the collar openings and in front of the wall openings to preclude the insertion of a prying instrument therethrough and disengagement of the rivets from the container walls thereby permitting backfeeding of the lock and slide fastener to afford access thereto.

A further object is the provision of a novel mounting means for a locked zippered security container which will preclude unauthorized opening thereof unless the container is damaged in tampering, and which will afford greater security and reassurance to depositors.

Still another object is to provide a locked zippered security container which may be produced without increasing the production cost of this type of container.

These and other objects and advantages will be apparent by referring to the accompanying drawings wherein FIG. 1 is a perspective view of a prior art locked zippered security container in closed and locked position;

Figure 1:
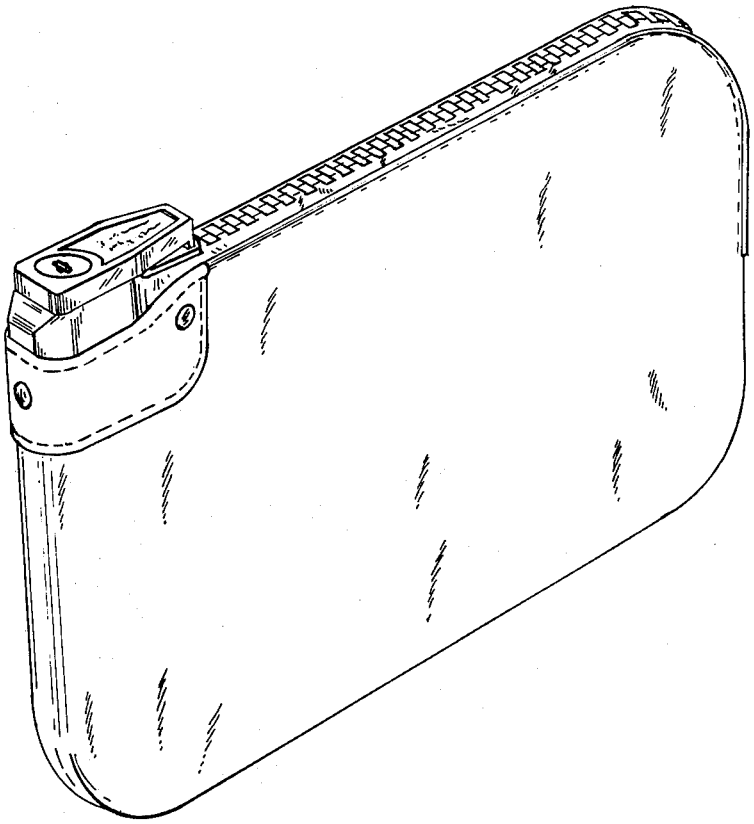
Figure 2:
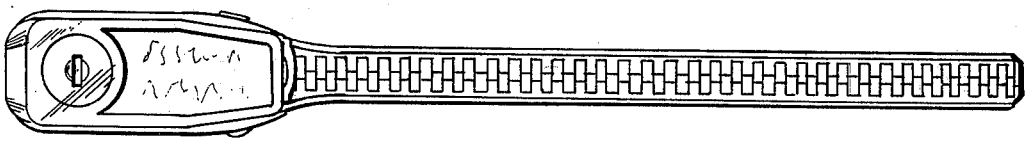
FIG. 2 is a top plan view of the container of FIG. 1.
Figure 3:
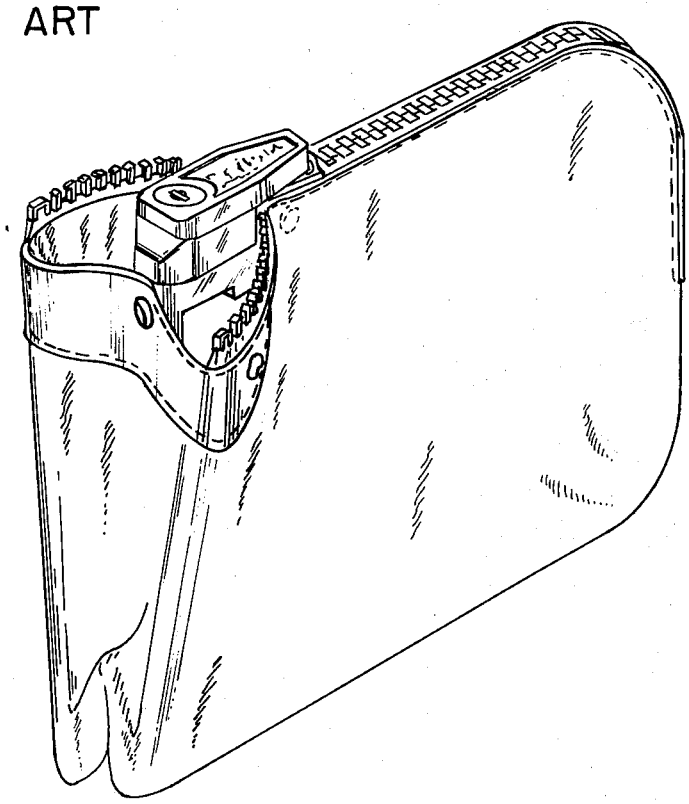
FIG. 3 is a perspective view of the prior art container of FIG. 1, after the lock mounting rivets have been button-holed and the lock and slide fastener back fed.
Figure 4:
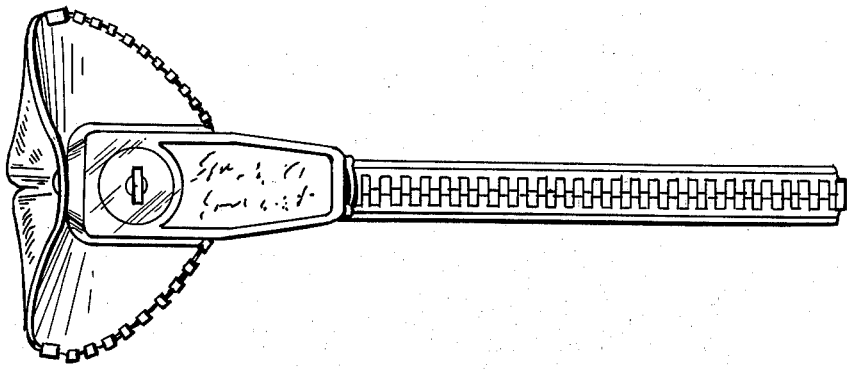
FIG. 4 is a top plan view of the container of FIG. 3.
Figure 5:
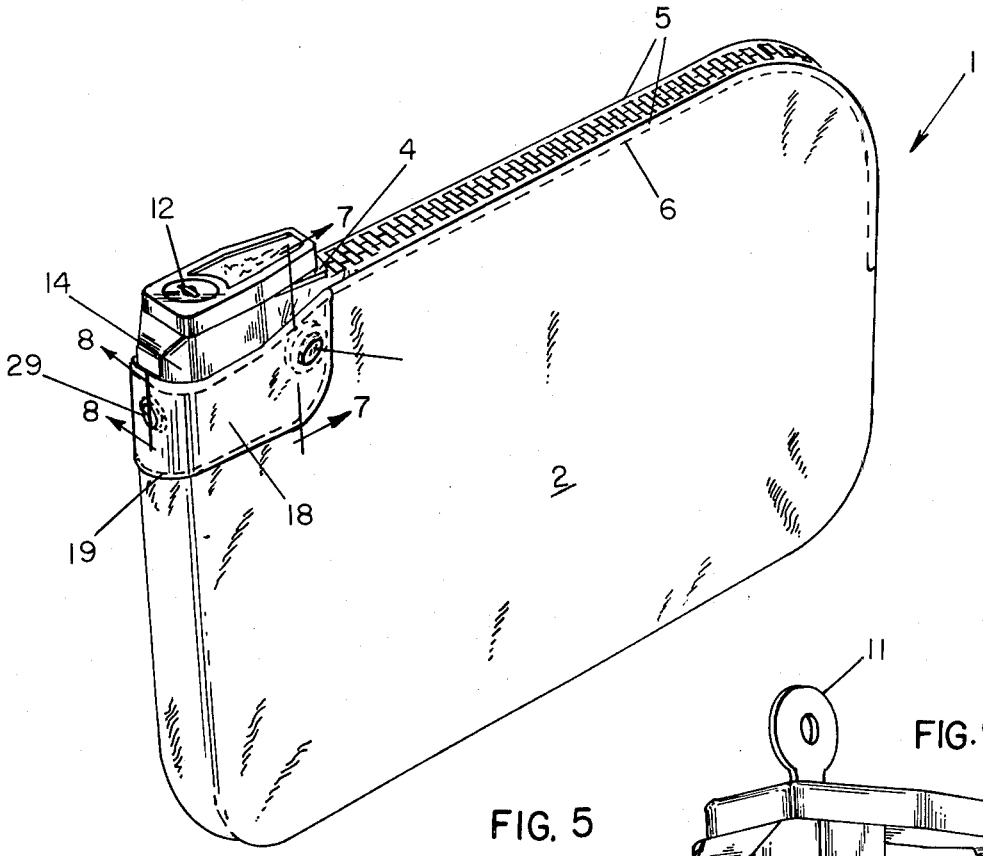
FIG. 5 is a perspective view of the security container of the present invention in closed and locked position.
Figure 9:
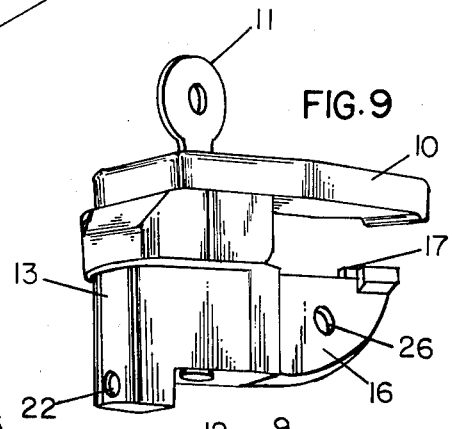
FIG. 9 is a perspective view of a lock cylinder and key.
Figure 6:
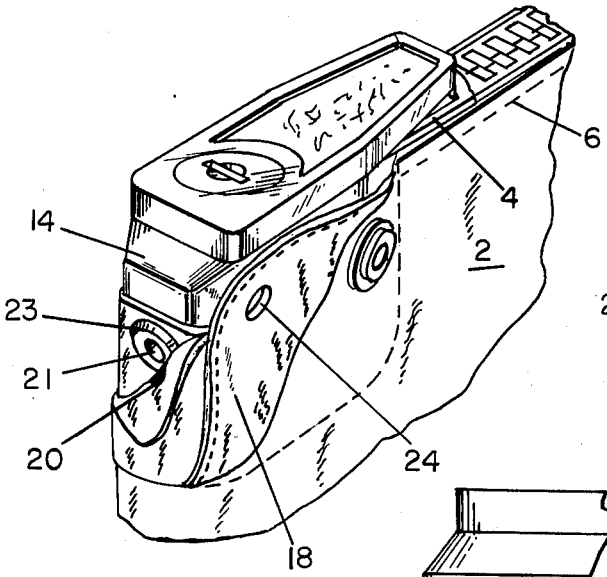
FIG. 6 is a partial perspective of the locked end of the container of FIG. 5, with the collar unstitched from the side panels and folded to disclose the washers and eyelets associated with the lock mounting rivets.
Figure 7:
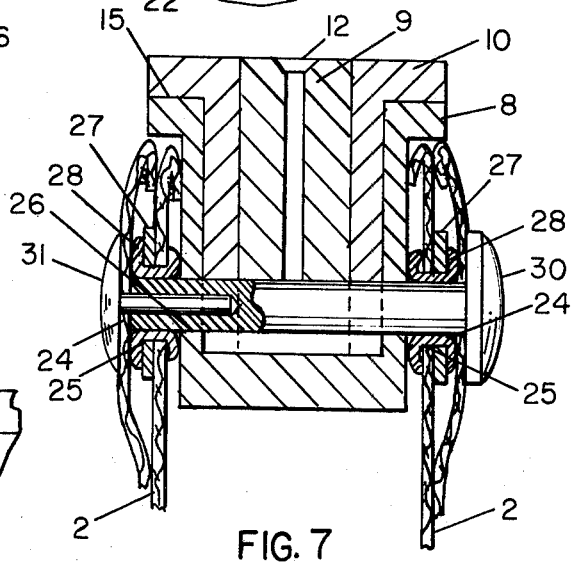
FIG. 7 is a partial vertical section through the container and lock along the line 7—7 of FIG. 5.
Figure 8:
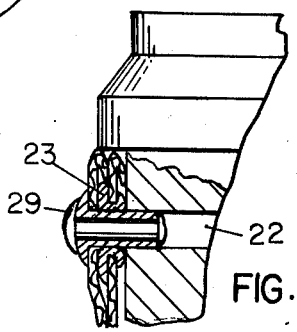
FIG. 8 is a partial vertical section on the line 8—8 of FIG. 5.

Referring more particularly to the drawings, wherein similar reference characters designate like parts throughout the several views, numeral 1 identifies a flexible money bag of the type generally employed in transporting day's receipts of a business to a financial institution and often depositing it in a night depository thereat. The bag is formed from the flat blank of suitable flexible material, such as Nylon, and is so folded to provide generally rectangular side panels 2 with the bottom edges and lower portion at one end of the panels being stitched or otherwise suitably secured together, not shown. The upper edges and one end remain unstitched to provide an entrance opening adapted to be closed by a conventional slide fastener assembly 4.

The slide fastener 4 is standard or conventional and may be of the so-called "zipper" type and includes the usual pair of cloth attachment strips 5 which are secured to the upper edges of the side panels 2 by rows of stitching 6. Each cloth strip 5 carries the usual series of spaced locking fingers, not shown, which interlace with each other under the control of a sliding lacing element to which there is movably attached a pull tab 7. As is customary, when the lacing element is slid in one direction along the upper edge of the bag 1, the locking fingers of the two strips 5 are progressively brought together and interlace to close the entrance opening. When slid in the other direction, the locking fingers are progressively unlaced and separated, as will be obvious.

The attachment strips and slide fastener assembly terminate short of the folded end of the bag to provide a space at the upper left hand corner of the bag to accommodate a lock housing 8 including a rotatable plug or cylinder 9 to which there is fixedly secured a keeper plate 10, and a conventional tumbler arrangement, not shown, for releasably locking the cylinder 9 to the housing 8 against turning movement therein. A key opening 12 in the upper end of housing 8 is adapted to receive a key 11 for actuating the tumbler arrangement and turning the cylinder.

Lock housing 8 is in the form of a metal block body having a curved rear face 13 which snugly interengages interiorly of the folded end of the bag and terminates in an enlarged head portion 14 formed with a flat upper face 15. The housing 8 has flat side faces 16 and a reduced or inset extension 16 with an upper face 17 forming an anvil or seating surface for the lacing element of slide fastener 4.

The rim portion of the bag, which is ultimately to be stretched tightly around the lock housing when the latter is inserted therewithin, is reinforced by a flat collar strip 18 of the same material as the bag and secured exteriorly thereto in the mouth region by stitching or the like 19. Aligned apertures 20 and 21, formed in collar 18, intermediate its ends and adjacent the bottom line of stitching 19, and the folded end of the bag panels, are aligned with a bore 22 in the lower extremity of lock housing 8. A metal eyelet 23, preferably of steel, is crimped around the periphery of bag aperture 21 and underlies aperture 20, for a purpose presently to be described. In addition, aligned apertures 24 and 25 are provided in the ends of the collar 18, adjacent stitching 19 and the rim of the bag and both side panels 2. Apertures 24–25 are aligned with a transverse bore 26 extending through lock housing extension 16. A metal backing washer 27, preferably of steel, is disposed over and extends around the exterior end of each panel aperture 25, and a metal eyelet 28, also preferably of steel and similar to eyelet 21, is crimped over each washer 27 so that the latter is affixed over and the eyelets 28 line and are clamped therewithin, for a purpose also to be hereinafter described.

The lock is now ready to be installed, so the housing thereof is positioned within the folded rear end of the bag entrance opening, with the upper rim of the bag closely underlying the head portion 14. The rim portion and reinforcing collar 18 are stretched tightly around the lock housing so that apertures 20–21 and 24–25 are aligned with bores 22–26 in the housing. A metal pop rivet 29 is driven by a suitable riveting tool, not shown, through apertures 20–21 and eyelet 23 so that the material of collar 18 is compressed against the eyelet and the latter is securely pressed and caused to be embedded in the panel. Thereafter, a metal drive rivet 30 is suitably applied through apertures 24–25 and bore 26 in the housing and a steel cap member 31 so that the lock is securely mounted within and secured to the bag.

To effect authorized entry to the bag, key 11 is inserted in and turned to rotate the plug and swing keeper plate 10 from overhanging engagement with the slide assembly 4 whereupon the latter is pulled by tab 7 and slid to open the bag, in the usual manner. However, if the lock may be partially disengaged from the bag by first button holing the attaching rivets back feeding of the slide assembly would be possible. Such button holing and back feeding cannot be effected in the present lock mounting arrangement.

It is important to note that, by virtue of the hereinabove described construction, the bag is so riveted to the lock that the apertures therein through which rivets 29 and 30 extend have the eyelet 23 and eyelets 28 and backing washers 27 so interposed between the collar strip 18 and panels that it is utterly impossible to insert a sharp or pointed instrument under the heads of the rivets so as to disengage or button hole the latter through the apertures to so free the lock from the bag that back feeding of the slide fastener assembly is possible. The attempted insertion of such a button holing implement will be blocked by the steel eyelets and backing washers so that the rivets may not be disengaged from panel opening 21 and 25. Even if this were possible, it will be evident that the material of the bag would be so damaged that unauthorized entry thereto would be apparent.

While a preferred embodiment of my novel lock mounting has been shown and described, it is to be understood that various changes and improvements may be made without departing from the scope and spirit of the appended claims.

What is claimed is:

1. In a zippered flexible walled security container having an elongated access opening, a lock housing disposed within the opening adjacent one end thereof, a slide fastener for closing said opening and including a lacing element movable along the opening between an open position wherein it is remote from the lock housing and a closed position wherein it is in close proximity to the lock housing and, in combination with the latter, closes the opening, a lock cylinder mounted for rotation in said housing, a keeper plate secured to the lock cylinder and projecting radially outwardly therefrom and adapted to overlie said lacing element and retain it in closed position, said lock housing having bores extending therethrough, apertures in said container adjacent one end and the access opening thereof, eyelet means affixed in said apertures, backing washer means associated with said eyelet means, and rivet means applied through said apertures and bores to mount said lock housing in said container whereby said backing washer means precludes button holing and disengagement of said rivet means and lock housing and back feeding of said slide fastener.

2. In a container and lock assembly according to claim 1, wherein reinforcing collar strip means is affixed to said container in the region of said lock mounting, and said strip means having apertures therein aligned with said container apertures.

3. In a container and lock assembly according to claim 2, wherein said eyelet means is affixed in the container apertures and underlies the apertures in said collar strip means.

4. In a container and lock assembly according to claim 1, wherein one aperture in said container has eyelet means therein, and the other apertures have eyelet and backing washer means associated therewith.

5. In a container and lock assembly according to claim 3, wherein the aligned apertures in said container and collar strip means extend through the end of and in opposing sides of said container in spaced relation, and wherein at least one of said eyelet means has backing washer means associated therewith.

6. In a container and lock assembly according to claim 5, wherein the aligned apertures in the end of said container and collar strip means have eyelet means affixed therein and the aligned apertures in the opposing sides of said container have eyelet means and backing washer means associated therewith.

7. In a container and lock assembly according to claim 3, wherein said eyelet means is crimped in and overlies said apertures.

8. In a container and lock assembly according to claim 6, wherein said eyelet means and said backing washer means overlie the apertures in said container and underlie the apertures in said collar strip means.

9. In a container and lock assembly according to claim 8, wherein said backing washer means underlies said eyelet means and is retained in position relative to said container apertures by the crimping of said eyelet means.

* * * * *